US006318557B1

(12) United States Patent
Zehnder

(10) Patent No.: US 6,318,557 B1
(45) Date of Patent: Nov. 20, 2001

(54) CANDLE SHIPPING CONTAINER

(75) Inventor: Kirk L. Zehnder, Los Angeles, CA (US)

(73) Assignee: Mercado Latino, Inc., Los Angeles, CA (US)

( * ) Notice: Subject to any disclaimer, the term of this patent is extended or adjusted under 35 U.S.C. 154(b) by 54 days.

(21) Appl. No.: 08/512,068

(22) Filed: Aug. 7, 1995

(51) Int. Cl.[7] ..... B65D 85/00
(52) U.S. Cl. ..... 206/525; 206/388; 249/94
(58) Field of Search ..... 206/388, 446, 206/589, 524.9, 525; 425/803; 249/91, 93, 94

(56) References Cited

U.S. PATENT DOCUMENTS 26,440 12/1859 Leonard et al. .
1,826,104 * 10/1931 Van Cleaf ..... 206/589
3,721,419 3/1973 Bolinger .
3,724,982 4/1973 Davis .
3,752,433 8/1973 Berman .
3,759,478 9/1973 Schmitt et al. .
3,799,492 3/1974 O'Laughlin .
3,974,996 8/1976 Violet .
3,998,922 * 12/1976 Weiss ..... 264/255
4,004,773 1/1977 Binder .
5,078,945 * 1/1992 Byron ..... 425/803

* cited by examiner

*Primary Examiner*—Shian Luong
(74) *Attorney, Agent, or Firm*—Nathan Boatner

(57) ABSTRACT

A shipping container for candles that are inside of glass containers with a wick holding grate that is part of the shipping container which permits candles to be produced inside of the shipping container and shipped or stored while the candle wax inside of the glass candle container has not fully cooled, the wick holding grate being used to keep the candle wick centered in the glass container while the candle wax cools.

2 Claims, 1 Drawing Sheet

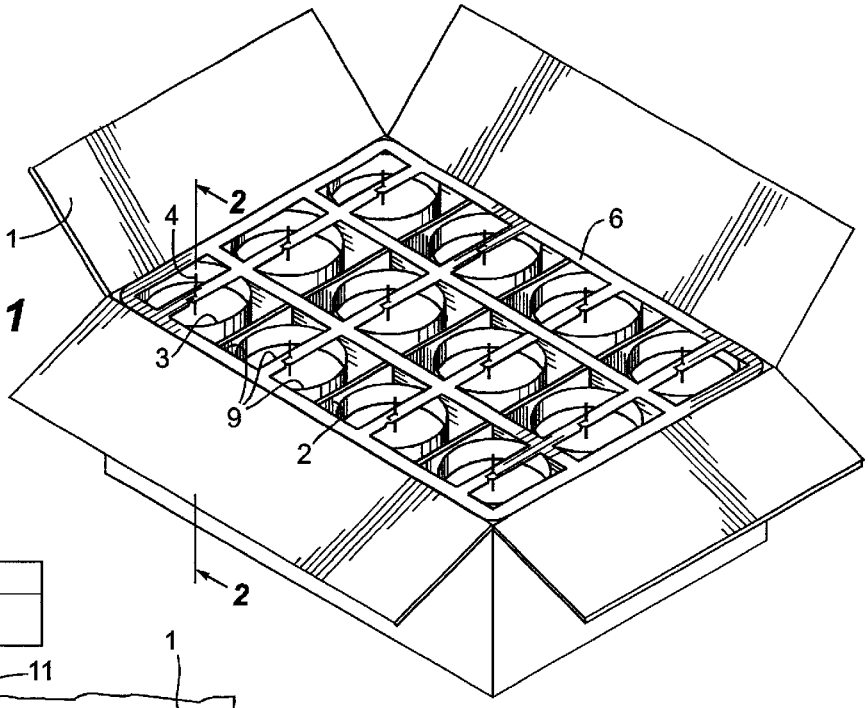
Fig. 1
Fig. 2
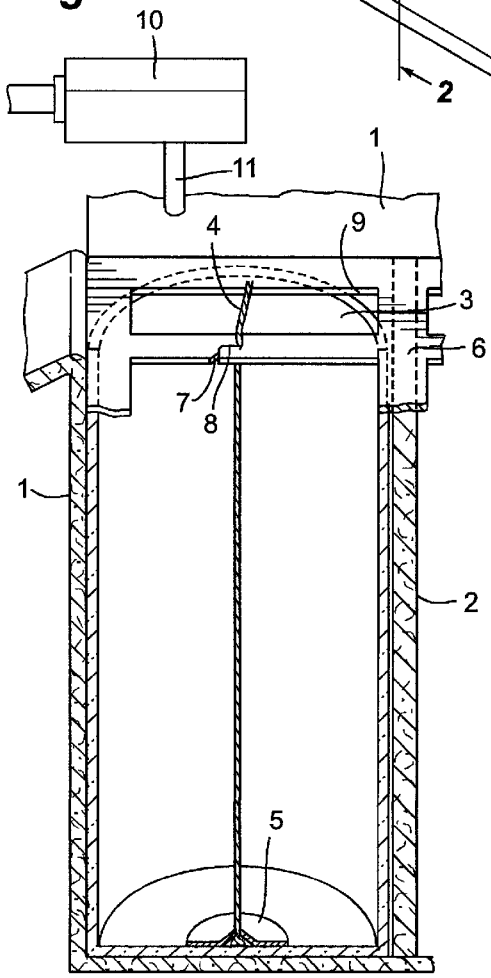
Fig. 3
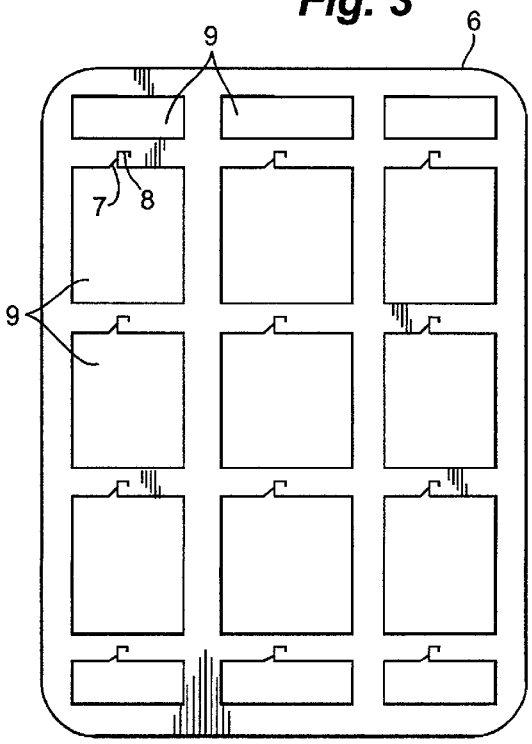

CANDLE SHIPPING CONTAINER

BACKGROUND OF THE INVENTION

Generally in the molding of candles a wick is necessarily centrally located in a mold into which suitable candle wax is injected and after the candle wax has sufficiently cooled the candle is ready to be burned in use. The candle mold can be a reusable mold which results in a candle that generally is placed in some sort of suitable candle holder then burned. Candles also can be molded in a container, usually made of glass and the candle is then burned in its container in lieu of being burned in some sort of candle holder.

During the manufacture of candles the candle wax generally shrinks as it cools in the mold or in the candle container and this can cause the candle wick to be pulled to one side of the candle. If the candle is made in its container, usually made of glass, then if the wick is not rigidly held in place during the cooling of the candle wax in the manufacturing process, the wick may move to one side of the glass container and when the candle is burned the heat of the flame could cause the glass container to break or even to shatter.

In candle manufacturing numerous methods of keeping the wick centered in the candle mold or candle container have been used. Generally to keep the candle wick centered in the mold or its container the wick must be fastened to the mold or container at both the top and the bottom. Also to keep the wick from moving to one side of the mold or container as the candle wax cools it is usually necessary to introduce two or more layers of wax into the mold or container the first wax layer being allowed to cool before additional wax is introduced into the candle mold or container in order to insure that the wick does not move to one side of the mold or container as the candle wax cools. This is a time consuming process and involves at the least two introductions of candle wax into the candle mold or container and the first introduced candle wax must be allowed to cool and shrink before additional wax can be introduced to complete the manufacture of the candle.

One method typically used in the manufacture of candles made in their container, the container being made of glass is described in U.S. Pat. No. 3,998,922 by Theodore H. Weiss. In this patent Weiss discloses the general method of 1) dispensing candle wax into its glass container; 2) allowing the first dispensed wax to cool and shrink; 3) inserting the wick in the solidified wax into a central cavity formed by a removable rod; 4) dispensing the second and final candle wax into the container; and 5) finally allowing all of the candle wax to cool so that the candle can be shipped to its destination and the wick will not move to the edge of the glass container and then possibly cause the glass container to break or shatter as the wick is eventually burned.

Other methods of manufacture of candles in their containers are more or less similar to that disclosed by Weiss. While this method of candle manufacture is practical the main disadvantage of having to dispense candle wax into the container at least twice is that it could take hours or even several days for the first dispensed candle wax to cool sufficiently for introduction of the next or final amount of hot candle wax into the container then an additional period of hours or even several days is necessary for all of the hot candle wax to sufficiently cool so that the candle can be safely shipped in its container and the wick suitably centered in the candle container so that the candle will burn properly. During the cooling period of the candle wax cooling fans can be used, but even so the time necessary for the candle wax to properly cool for shipment of the candle could take hours or as is usually the case, several days.

SUMMARY OF THE INVENTION

The present invention consists of a candle shipping container consisting of the candles in the container with a wick holding grate made of shipping material such as cardboard used to hold the wick in place in the candle container as the candle wax cools and shrinks. The principle object of the present invention is to eliminate the necessity of more than one introduction of hot candle wax into the candle container prior to shipment of the finished candle. This eliminates any lengthy waiting period necessary for the candle wax to suitably cool prior to shipment of the finished candle since the wick holder in the shipping container is shipped along with the candles to the customer.

IN THE DRAWING

FIG. 1 is a perspective view of the shipping container.

FIG. 2 is a vertical sectional view of a candle assembly inside of the shipping container.

FIG. 3 is a top view of the notched grate.

DESCRIPTION OF A PREFERRED EMBODIMENT

In a preferred form of the invention a glass candle container 3 is placed in the shipping carton 1. The shipping carton generally contains 12 candles in glass containers 3. The shipping carton typically has partitions 2 to separate the candles which are in glass containers 3 in order to prevent breakage of the glass containers 3 during shipment.

The candle wick 4 is held in place at the bottom of the glass candle container 3 by a metal base 5. Candle wax, preferably paraffin wax, is introduced by means of a hot wax container 10 through a nozzle 11. The candle wax in this invention is introduced into the glass candle container 3 after the candle wick 4 has been placed in the glass candle container 3. The candle wax is introduced into the glass candle container 3 until the glass candle container 3 is completely filled with the candle wax.

After all twelve glass candle containers 3 containing candle wicks 4 have been completely filled with the candle wax, the grate 6 is placed over the candle containers 3 while the candle wax is still hot. The candle wick 4 is passed through the grate aperture 9 then the candle wick 4 is secured to the grate 6 by means of grooves 8 in the grate 6. The grooves 8 have notches 7 which permits ease of insertion of the candle wick 4 into the notches 7. This operation can be accomplished manually or with suitable jigs on an assembly line.

The shipping carton 1 is then closed and the hot candle wax is allowed to cool in the shipping container which is now comprised of the candles in the glass candle containers 3, partitions 2, the grate 6, and the carton 1. The shipping container can now be loaded on pallets or stacked for storage and shipped to customers.

The above description of the preferred embodiment of the invention is for purposes of illustration only and not to limit the scope of the invention. The scope of this invention is intended to be limited to the following claims and their equivalents and not by the above description and drawings.

What is claimed is:

1. A candle shipping container comprising:

a shipping carton with partitions in which candle containers of candles are placed, each candle having a candle wick, and a candle wick holding grate situated over a top of each candle container whereby each candle wick in the shipping carton is held in place inside of the shipping container during the entire cooling process of the hot candle wax introduced into each candle container during the manufacturing process of the candles.

2. The candle shipping container described in claim 1 wherein the candle wick holding grate consists of a base member with apertures which permit each candle wick to be passed therethrough and notches on the apertures in the base member which hold each candle wick in place during the entire wax cooling process of the manufacture of the candle whereby the candle wick holding grate can be shipped along with the candles as part of the shipping container.

* * * * *